US012751591B2

(12) United States Patent
Liu et al.

(10) Patent No.: US 12,751,591 B2
(45) Date of Patent: Oct. 6, 2026

(54) CLEANING APPARATUS, AND HOUSING AND SENSOR USED THEREFOR

(71) Applicant: Beijing Roborock Technology Co., Ltd., Beijing (CN)

(72) Inventors: Xiaoming Liu, Beijing (CN); Mingchuan Wang, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 419 days.

(21) Appl. No.: 18/264,480

(22) PCT Filed: Sep. 15, 2021

(86) PCT No.: PCT/CN2021/118565
§ 371 (c)(1),
(2) Date: Aug. 7, 2023

(87) PCT Pub. No.: WO2022/166211
PCT Pub. Date: Aug. 11, 2022

(65) Prior Publication Data

US 2024/0298860 A1 Sep. 12, 2024

(30) Foreign Application Priority Data

Feb. 6, 2021 (CN) ..... 202120364484.3
Mar. 9, 2021 (CN) ..... 202120509444.3

(51) Int. Cl.
*A47L 9/28* (2006.01)

(52) U.S. Cl.
CPC ..... *A47L 9/2826* (2013.01); *A47L 9/2894* (2013.01); *A47L 2201/06* (2013.01)

(58) Field of Classification Search
CPC ... A47L 9/2826; A47L 9/2894; A47L 2201/06
See application file for complete search history.

(56) References Cited

U.S. PATENT DOCUMENTS 10,121,820 B1 * 11/2018 Chen ..... H10F 39/182
12,004,706 B2 * 6/2024 Liggett ..... A47L 9/009
(Continued)

FOREIGN PATENT DOCUMENTS

CN 208187432 U 12/2018
CN 110470332 A * 11/2019 ..... B08B 5/02
(Continued)

OTHER PUBLICATIONS

European Search Report of application No. 21924208.8 dated Nov. 22, 2024.
(Continued)

*Primary Examiner* — Marc Carlson
(74) *Attorney, Agent, or Firm* — Calfee, Halter & Griswold LLP

(57) ABSTRACT

A cleaning apparatus, a housing and a sensor used therefor. The housing is provided with a mounting hole for assembling the sensor; a hole wall of the mounting hole is obliquely provided, such that a cross-sectional area of the mounting hole is gradually increased from the inside to the outside; and a reflective structure is arranged on the hole wall, and the reflective structure divides the hole wall into a plurality of reflecting surfaces. The sensor comprises a shell and a sensor assembly arranged inside the shell, wherein the shell is provided with a lens; a cover is used for closing an opening of a main body portion; the cover is connected to the main body portion by means of a threaded member; and a sealing member is provided between the cover and the main body portion, such that the main body portion and the cover are in sealing connection.

10 Claims, 4 Drawing Sheets

(56) References Cited

U.S. PATENT DOCUMENTS

| | | | | |
|---|---|---|---|---|
| 2007/0244610 | A1* | 10/2007 | Ozick | A47L 11/4072 342/417 |
| 2009/0157225 | A1* | 6/2009 | Jung | G01B 11/24 700/250 |
| 2016/0352112 | A1* | 12/2016 | Shudo | A47L 9/28 |
| 2017/0001311 | A1* | 1/2017 | Bushman | A47L 9/2852 |
| 2017/0031366 | A1* | 2/2017 | Shamlian | G01B 11/026 |
| 2018/0263447 | A1* | 9/2018 | Yim | A47L 9/009 |

FOREIGN PATENT DOCUMENTS

| | | | | |
|---|---|---|---|---|
| CN | 210871316 | U | | 6/2020 |
| CN | 212574787 | U | * | 2/2021 |
| EP | 3669731 | A1 | | 6/2020 |

OTHER PUBLICATIONS

International Search Report from PCT/CN2021/118565 dated Nov. 2, 2021.

* cited by examiner

CLEANING APPARATUS, AND HOUSING AND SENSOR USED THEREFOR

CROSS-REFERENCE TO RELATED APPLICATIONS

This application is a U.S. National Stage of International Application No. PCT/CN2021/118565, filed on Sep. 15, 2021, which claims priority to Chinese Patent Application No. 202120509444.3, filed on Mar. 9, 2021, and Chinese Patent Application No. 202120364484.3, filed on Feb. 6, 2021, which are incorporated herein by reference in their entireties.

TECHNICAL FIELD

The present application belongs to the field of cleaning device technologies, and in particular relates to a cleaning device as well as a housing and a sensor thereof.

BACKGROUND

As important components of electronic products, some sensors, such as infrared sensors and other optical sensors, work in relation to the strength of signals received, and can only confirm certain status when receiving light intensity exceeding a certain threshold. In some cases, a sensor needs to be provided inside an electronic product to transmit and receive a signal via a mounting hole in the electronic product. However, due to the reflection by a hole wall, a detection result of the sensor may be distorted, resulting in a misjudgment. In addition, water vapor may enter the sensor when the electronic product is used in a humid environment, and thus adversely affects the service life of sensor parts as well as transmission and receiving of the signal by the sensor, resulting in distortion of the detection result.

SUMMARY

In an aspect, embodiments of the present application provide a housing of a cleaning device. The housing includes a mounting hole for mounting a sensor, wherein a hole wall of the mounting hole is inclined such that a cross-sectional area of the mounting hole gradually increases from the inside to the outside; the hole wall is provided with a reflective structure; and the reflective structure divides the hole wall into a plurality of reflecting surfaces.

In an optional embodiment, the hole wall is provided with multiple steps, and the multiple steps form the reflective structure.

In an optional embodiment, the step includes a step surface and a side surface, and the step surface is parallel to a cross section of the mounting hole.

In an optional embodiment, the step surface is a matte surface.

In an optional embodiment, the side surface is perpendicular to the cross section of the mounting hole.

In an optional embodiment, each of the steps continuously extends along the hole wall.

In an optional embodiment, a wall surface of the mounting hole is a frustum-shaped surface.

In an optional embodiment, the mounting hole is provided at a bottom of the housing, and the sensor is oriented to transmit or receive a signal vertically downwards when the cleaning device is in operation.

In an optional embodiment, the mounting hole is disposed close to an edge of the housing, and a notch is provided in a side of the hole wall close to the edge.

In an optional embodiment, a surface of the reflective structure is formed as a matte film.

In an optional embodiment, the sensor includes a cliff sensor.

In another aspect, an embodiment of the present application provides a sensor. The sensor includes a housing and a sensor assembly disposed in the housing, wherein the housing is provided with a lens and includes: a main body portion having an opening at one end; a cover body configured to close the opening of the main body portion and connected to the main body portion by means of a threaded part; and a sealing part disposed between the cover body and the main body portion such that the main body portion and the cover body are hermetically connected.

In an optional embodiment, the sensor assembly includes: a support, fixedly connected to the housing; a transmitting sensor, disposed on the support and configured to transmit a signal; and a receiving sensor, disposed on the support and configured to receive the signal.

In an optional embodiment, the support and the cover body are fixedly connected, and the support is provided with sensor fixing positions for disposing the transmitting sensor and the receiving sensor respectively.

In an optional embodiment, the sensor fixing position includes: an accommodating groove, configured to accommodate the transmitting sensor or the receiving sensor; and a positioning groove, communicated with the accommodating groove and configured to accommodate a radial projection on the transmitting sensor or the receiving sensor.

In an optional embodiment, the lens and the housing are integrally injection molded.

In an optional embodiment, the lens is disposed at the other end of the main body portion opposite to the end having the opening; and the other end of the main body portion is provided with a partition portion that divides the lens into a first lens and a second lens.

In an optional embodiment, a side wall of the main body portion is provided with at least two fixing bulges, and the fixing bulge is provided with a threaded hole; the cover body is provided with a through hole opposite to the threaded hole; and the threaded part passes through the through hole to be in thread fit with the threaded hole so as to secure the cover body to the main body portion.

In an optional embodiment, the threaded hole is a blind hole.

In an optional embodiment, the fixing bulge is disposed on an outer wall surface of the side wall of the main body portion, the cover body is provided with a lug corresponding to the fixing bulge, and the through hole is formed in the lug.

In an optional embodiment, the end having the opening of the main body portion is provided with a sealing groove surrounding the opening, or the cover body is provided with a sealing groove, and the sealing part is embedded into the sealing groove.

In an optional embodiment, the cover body is provided with a wire hole that allows a wire connected to the sensor assembly to pass through; a sealing block is disposed between a hole wall of the wire hole and the wire; and the sealing block is connected with the cover body in a clamping manner.

In yet another aspect, an embodiment of the present application provides a cleaning device. The cleaning device includes the housing of the cleaning device as described in any one of the above embodiments and/or the sensor as described in any one of the above embodiments.

It should be understood that both the foregoing general description and the following detailed description are only exemplary and explanatory and are not intended to limit the present application.

An overview of various implementations or examples of the technologies described in the present application is not a comprehensive disclosure of the entire scope or all features of the disclosed technologies.

BRIEF DESCRIPTION OF THE DRAWINGS

In the accompanying drawings, which are not necessarily drawn to scale, the same reference numbers may denote similar parts in different views, and the same reference numbers with letter suffixes or different letter suffixes may denote different examples of similar parts. The accompanying drawings illustrate various embodiments generally by way of example but not limitation, and together with the description and claims serve to explain embodiments of the present application. Where appropriate, the same reference numbers will be used throughout the accompanying drawings to refer to the same or similar parts. Such embodiments are illustrative, and are not intended to be exhaustive or exclusive embodiments of the present device or method.

REFERENCE NUMBERS IN THE DRAWINGS

1—mounting hole; 11—hole wall; 12—reflective structure; 121—step surface; 122—side surface; 123—notch; 124—transitional surface; 2—sensor; 3—center line; 10—main body part; 110—partition portion; 120—fixing bulge; 20—cover body; 210—lug; 220—through hole; 230—wire hole; 240—mounting groove; 30—sealing part; 40—threaded part; 50—lens; 510—first lens; 520—second lens; 60—sensor assembly; 610—support; 620—transmitting sensor; 630—receiving sensor; 640—sensor fixing position; 6410—accommodating groove; 6420—positioning groove; 70—sealing block; and 80—wire.

DETAILED DESCRIPTION

The technical solutions of the embodiments of the present application will be described clearly and completely with reference to the accompanying drawings in the embodiments of the present application, to present the objectives, technical solutions, and advantages of the embodiments of the present application more clearly. It is apparent that the described embodiments are only part but not all embodiments of the present application. According to the described embodiments of the present application, all of the other embodiments obtained by a person of ordinary skill in the art without any creative work shall fall within the protection scope of the present application.

Unless otherwise defined, technical terms or scientific terms used in the present application shall have the ordinary meanings as understood by those of ordinary skill in the art. The terms "first", "second", and the like used in the present application do not denote any order, quantity, or importance, but are merely used to distinguish different components. The term "comprise", "include", or the like is intended to mean that the elements or objects before said term cover the elements or objects and equivalents listed after said term, without excluding other elements or objects. The term "connection", "connected", or the like is not limited to physical or mechanical connection, and may include electrical connection and the connection may be direct or indirect. The terms "upper", "lower", "left", "right" and the like are only used to indicate the relative positional relationship, and when the absolute position of a described object changes, the relative positional relationship may also change accordingly.

In order to keep the following description of the embodiments of the present application clear and concise, the detailed description of known functions and known parts is omitted in the present application.

Referring to FIGS. 1 to 4, an embodiment of the present application provides a housing of a cleaning device. The housing includes a mounting hole 1 for mounting a sensor 2. A hole wall 11 of the mounting hole 1 is inclined such that a cross-sectional area of the mounting hole 1 gradually increases from the inside to the outside. The hole wall 11 is provided with a reflective structure 12; and the reflective structure 12 divides the hole wall 11 into a plurality of reflecting surfaces.

Figure 3:
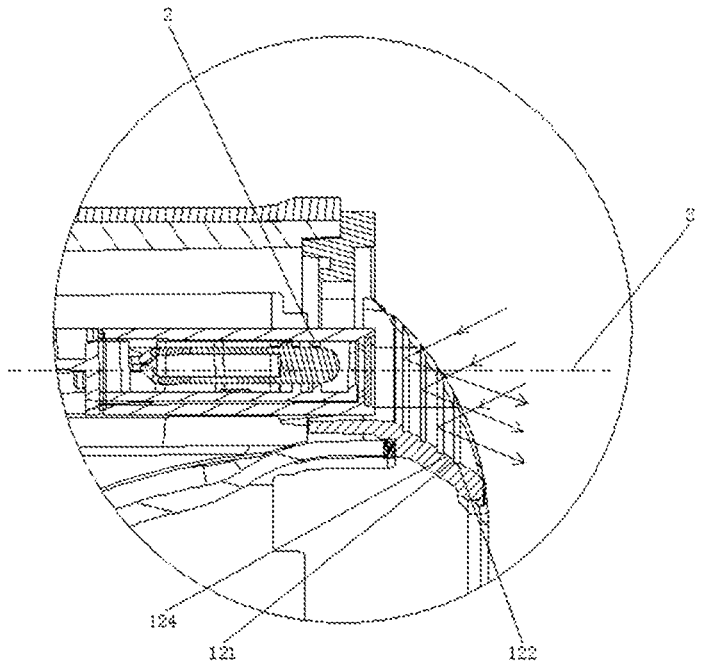
FIG. 3 is a schematic sectional view taken along B-B in FIG. 1.
Figure 4:
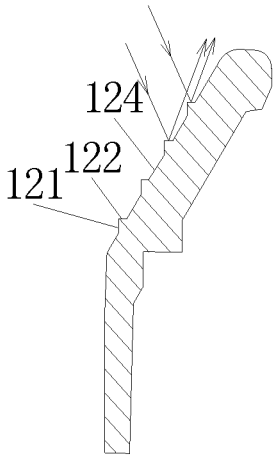
FIG. 4 is a partial sectional view of a housing according to another embodiment of the present application.

The embodiment of the present application provides the housing of the cleaning device. The housing includes the mounting hole 1 for mounting the sensor 2. The hole wall 11 of the mounting hole 1 is inclined such that the cross-sectional area of the mounting hole 1 gradually increases from the inside to the outside. Since the hole wall 11 is inclined, signal transmission and receiving by the sensor 2 may not be adversely affected when the mounting hole 1 is deep. The hole wall 11 is provided with the reflective structure 12 that divides the hole wall 11 into the plurality of reflecting surfaces. Thus, the direction of reflected light from the hole wall 11 can be controlled by different designs of the reflective structure 12, and hence the impact on the sensor 2 from the reflection by the hole wall 11 can be reduced. Referring to FIGS. 3 and 4, arrowed lines represent paths of light reflected by the reflective structure 12. By providing the reflective structure 12, the hole wall 11 with a large area, which is used as the reflecting surface, is divided into the plurality of reflecting surfaces, such that the reflection path and the effective reflecting area are changed. Thus, signals such as light reflected into the sensor 2 by the wall surface are reduced, thereby reducing the misjudgment.

The cleaning device is provided with a cliff sensor mounted at the bottom of the mounting hole 1. A signal transmitted by the sensor 2 is transmitted to the ground through an opening of the mounting hole 1 and then reflected by the ground, and the sensor 2 receives the signal reflected by the ground. The signal received by the sensor 2 may change when the cleaning device walks to a cliff (with a large drop), and thus it can be determined that the cleaning device is at an edge of the cliff and the cleaning device can be prevented from dropping by turning, stopping, etc. If the signal reflected by the ground is reflected into the sensor 2 by the hole wall 11 of the mounting hole 1, the amount of the signal received by the sensor 2 is larger than that of the signal directly reflected into the sensor 2 by the ground. The sensor 2 may make a misjudgment when enough signals are reflected into the sensor 2 by the hole wall 11. For example, the transmitted and reflected signal is infrared light when the cliff sensor is an infrared sensor. According to the present application, the reflective structure 12 is disposed on the hole wall 11 to divide the hole wall 11 into the plurality of reflecting surfaces, such that the reflection path and the effective reflecting area are changed, which can reduce the impact caused by the reflection by the hole wall 11.

In the embodiment of the present application, the reflective structure 12 is not limited in specific structure or form as long as the hole wall 11 with the large area can be divided into the plurality of reflecting surfaces to reduce the overall effect of large-area reflection. The reflective structure 12 may be a regular geometry or an irregular geometry formed on the hole wall 11. The regular geometry includes a polyhedron. In the case that the reflective structure 12 is a polyhedron, signals such as light can be reflected in a specific direction, thereby ensuring that at least half of the signals on the hole wall 11 are not reflected to the sensor 2. The specific shape of the polyhedron is not limited.

Figure 1:
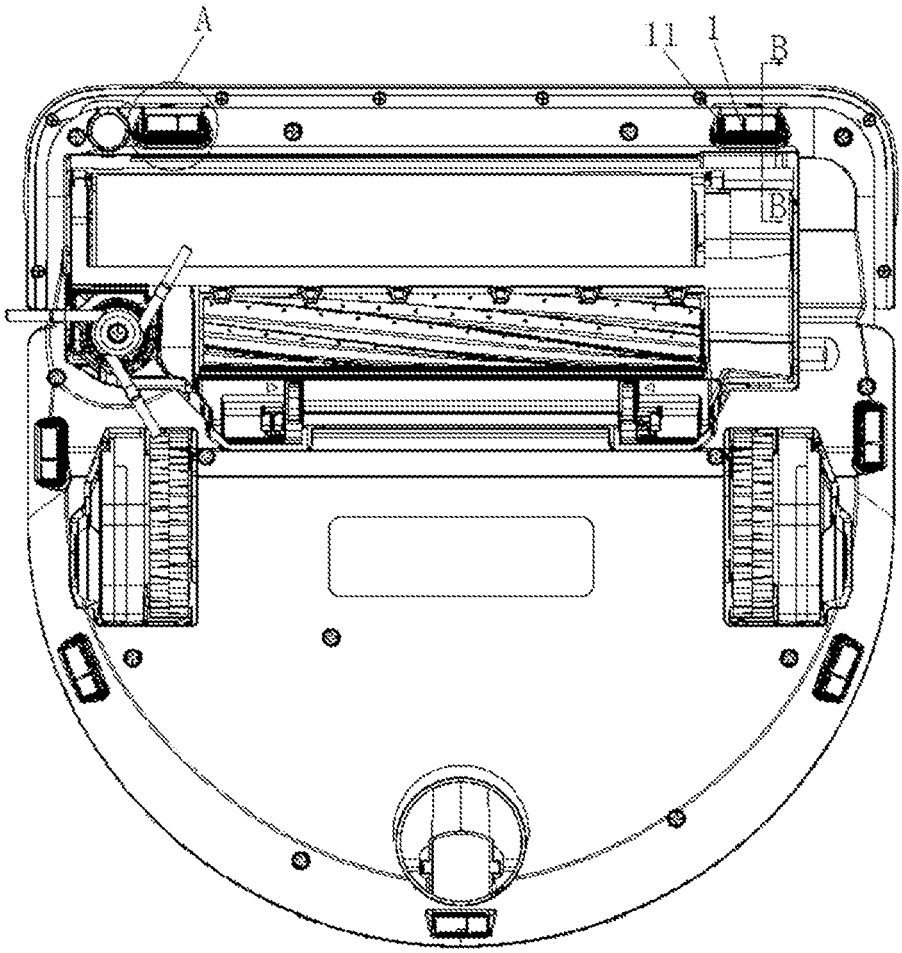
FIG. 1 is a schematic structural diagram of the bottom of a housing according to an embodiment of the present application.
Figure 2:
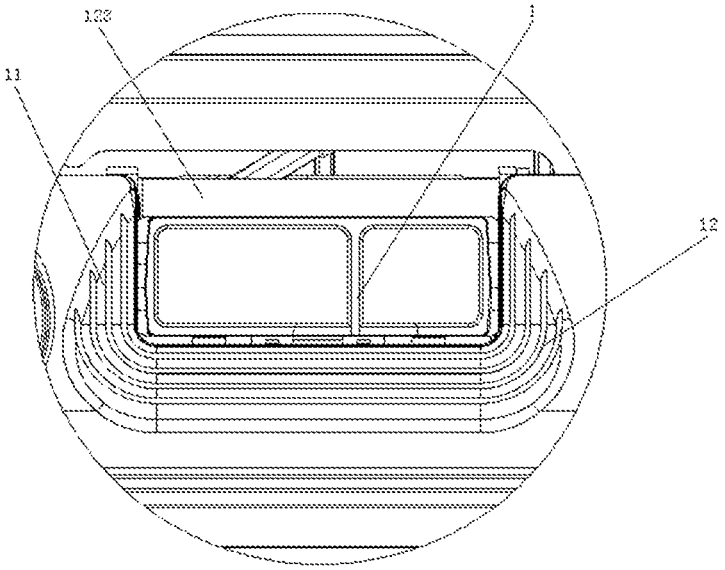
FIG. 2 is an enlarged schematic diagram of part A in FIG. 1.

Referring to FIGS. 2 and 3, in some embodiments, the hole wall 11 is provided with multiple steps, and the multiple steps form the reflective structure 12. In an embodiment of the present application, the reflective structure 12 adopts the multiple steps. The step is at least structurally provided with two surfaces, namely a step surface 121 and a side surface 122. The multiple steps on the hole wall 11 are one of the above-mentioned polyhedrons. The multiple steps are formed on the hole wall 11 to divide the entire hole wall 11 into the plurality of reflecting surfaces, such that the entire hole wall 11 may be prevented from being used as a large reflecting surface to reflect the signal to the sensor 2. Thus, the structure of the steps can ensure that half of the signals are not reflected to the sensor 2.

Referring to FIG. 3, in some embodiments, the step includes the step surface 121 and the side surface 122. The step surface 121 is parallel to the cross section of the mounting hole 1. The step surface 121 is parallel to the cross section, i.e., the step surface 121 is perpendicular to a center line 3 of the mounting hole 1. Thus, the step surface 121 can reflect the signal out of the mounting hole 1 to prevent the signal from entering the sensor 2.

In some embodiments, the step surface 121 is a matte surface. According to the embodiment of the present application, since the step surface 121 is the matte surface, the reflected light is diffusely reflected, which further attenuates the intensity of the reflected light.

In an embodiment of the present application, the surface of the reflective structure 12 may also be subjected to matte surface treatment. In an exemplary embodiment, a matte film is formed on the surface of the reflective structure 12. For example, a matte film is formed on the step surface 121 to further attenuate the intensity of the reflected light.

In some embodiments, the side surface 122 is perpendicular to the cross section of the mounting hole 1. The side surface 122 is parallel to the center line 3 of the mounting hole 1 and cooperates with the step surface 121. Thus, it can be ensured that at least half of the signals are reflected out of the mounting hole 1 instead of entering the sensor 2, which greatly reduces misjudgments made by the sensor 2.

In the embodiments of the present application, all the steps may be continuous or intermittent.

Referring to FIGS. 2 and 3, in some embodiments, each step extends continuously along the hole wall 11. Each step extends continuously along the circumference of the hole wall 11. The way to form the step is simple and easy, and is diverse in form.

In an exemplary embodiment, transverse carving is carried out on the hole wall 11 to form a V-shaped groove in the circumferential direction. Two groove walls of the V-shaped groove are perpendicular to each other. The two groove walls of the V-shaped groove form the step surface 121 and the side surface 122 of one step. By means of carving, multiple continuous steps are formed on the hole wall 11, thereby attenuating light reflected by a continuous smooth surface.

Certainly, the way to form the reflective structure 12 is not limited to the above-mentioned way of direct milling on the hole wall 11, and the reflective structure 12 may also be attached to the hole wall 11. In an exemplary embodiment, the reflective structure 12 (e.g., multiple steps) may be formed by means of molding by coating the hole wall 11 with an adhesive layer, and then cured. The adhesive layer may be a light-curing adhesive. Curing is performed by means of UV illumination.

Every two adjacent steps may be directly connected, and in the case that two adjacent steps are directly connected, the side surface 122 of one of the steps is directly connected to the side surface 122 of the other step. Every two adjacent steps may also be indirectly connected, and in the case that two adjacent steps are indirectly connected, the side surface 122 of one of the steps is connected to the side surface 122 of the other step by a transitional surface 124. For example, in the embodiment shown in FIGS. 2 and 3, the transitional surface 124 is formed by the hole wall 11 that is not subjected to carving.

In an embodiment of the present application, the wall surface of the mounting hole 1 is not limited in shape, and may be irregularly shaped or regularly shaped.

In some embodiments, the wall surface of the mounting hole 1 is a frustum-shaped surface, which includes a round table surface and a truncated pyramid surface. In an exemplary embodiment, the wall surface of the mounting hole 1 is a truncated pyramid surface.

In some embodiments, the mounting hole 1 is provided at the bottom of the housing, and the sensor is oriented to transmit or receive a signal vertically downwards when the cleaning device is in operation. For example, the cliff sensor 2 of the cleaning device needs to be disposed at the bottom of the housing so as to transmit a signal to the ground.

In some embodiments, the mounting hole 1 is disposed close to an edge of the housing, and a notch 123 is provided on a side of the hole wall 11 close to the edge. By forming the notch 123 in the side of the hole wall 11 close to the edge of the housing, the hole wall 11 can be prevented from adversely affecting the signal. The size of the notch 123 is not limited. For example, the notch 123 may be formed in the entire or partial hole wall from the opening of the mounting hole 1 to the bottom of the mounting hole, i.e., the height of the side of the hole wall 11 where the notch 123 is formed is smaller than the height of the other part of the hole wall 11.

An embodiment of the present application provides a cleaning device. The cleaning device includes the housing of the cleaning device as described in any one of the above embodiments.

The cleaning device according to the embodiment of the present application further includes a cliff sensor 2 mounted at the bottom of the mounting hole 1. The cliff sensor 2 may be an infrared sensor 2 and a laser sensor 2.

In the embodiments of the present application, the cleaning device includes a sweeping robot, a mopping robot, a mopping-sweeping robot, a disinfecting robot and the like.

An embodiment of the present application further provides a sensor, which may be, for example, the sensor 2 in the cleaning device described in any one of the above embodiments, and certainly, the present application is by no means limited thereto. That is, the sensors described in the following embodiments may also be any other sensors in the cleaning device in addition to the sensor 2 described above.

Figure 5:
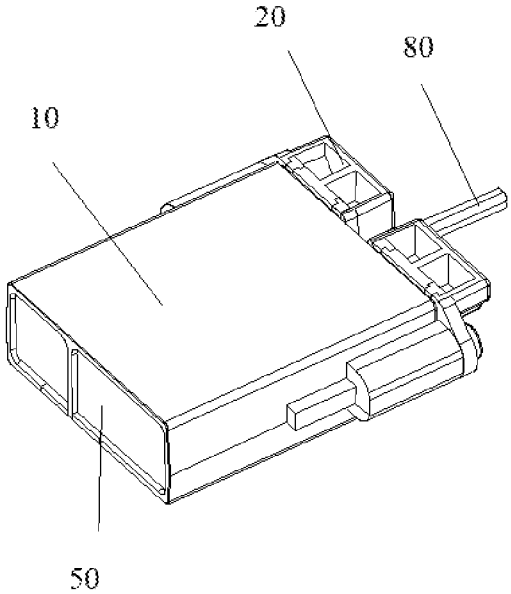
FIG. 5 is a schematic structural diagram of a sensor according to an embodiment of the present application.
Figure 6:
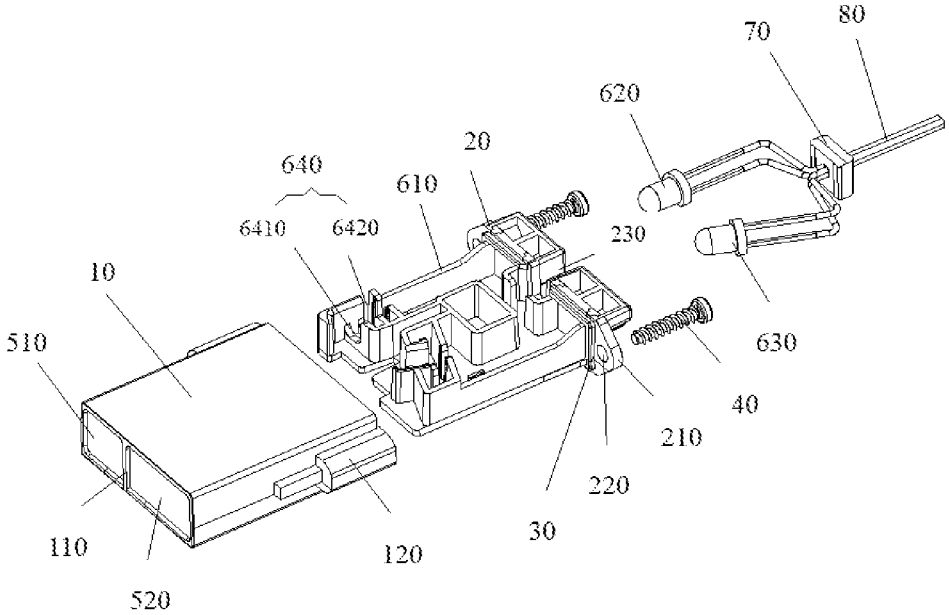
FIG. 6 is a schematic exploded view of a structure of the sensor according to the embodiment of the present application.
Figure 7:
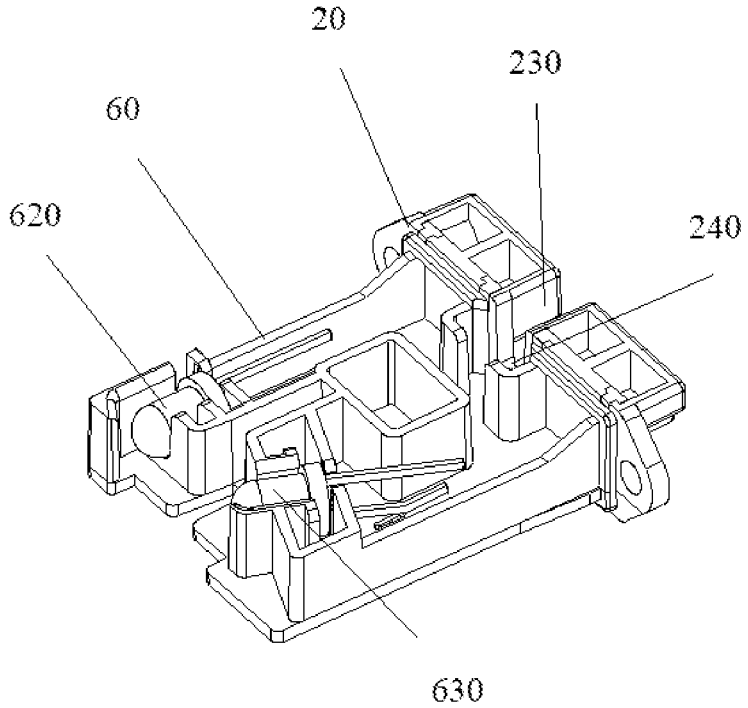
FIG. 7 is a schematic diagram of a cover body and sensor assembly components of the sensor according to the embodiment of the present application.

Referring to FIGS. 5 to 7, in an embodiment of the present application, the sensor includes a housing and a sensor assembly 60 disposed in the housing. The housing includes a main body portion 10 and a cover body 20.

The main body portion 10 has an opening at one end. The cover body 20 is configured to close the opening of the main body portion 10 and connected to the main body portion 10 by means of a threaded part 40.

A sealing part 30 is disposed between the cover body 20 and the main body portion 10 such that the main body portion 10 and the cover body 20 are hermetically connected.

In an embodiment of the present application, the housing may also be provided with a lens 50 that allows signals transmitted and received by the sensor assembly 60 in the housing to pass through.

In the sensor provided by the embodiment of the present application, the main body portion 10 has the opening at one end, and the opening may be sealed by the cover body 20. The sealing part 30 is disposed between the main body portion 10 and the cover body 20; and the main body portion 10 and the cover body 20 are connected by means of the threaded part 40, such that the cover body 20 and the main body portion 10 are hermetically connected. The main body portion 10 and the cover body 20 constitute the sealed housing, thus it is difficult for the outside water vapor to enter the housing. Therefore, neither the service life nor the using effect of the sensor assembly 60 disposed in the housing may be adversely affected.

In an embodiment of the present application, the sensor assembly 60 is a module composed of various parts, is disposed in the housing as a whole, and is secured relative to the housing.

In some embodiments, the sensor assembly 60 includes a support 610, a transmitting sensor 620, and a receiving sensor 630. The transmitting sensor 620 is configured to transmit a signal, and the receiving sensor 630 is configured to receive a signal. For example, the transmitting sensor 620 is configured to transmit light, and the receiving sensor 630 is configured to receive the reflected light.

Both the transmitting sensor 620 and the receiving sensor 630 are disposed on the support 610. The transmitting sensor 620 and the receiving sensor 630 are assembled on the support 610 to form a module. The sensor assembly 60 is disposed in the housing and secured relative to the housing.

The specific manner in which the sensor assembly 60 is secured relative to the housing is not limited.

In some embodiments, the housing is provided with a limiting structure therein, and in the case that the sensor assembly 60 is assembled in the housing, the limiting structure cooperates with the support 610 to secure the support 610 relative to the housing. In an exemplary embodiment, the limiting structure in the housing may be that the inner wall surface of the housing is provided with a flange, and the flange cooperates with the support 610 to limit the support 610. The support 610 on which the transmitting sensor 620 and the receiving sensor 630 are mounted is mounted in the main body portion 10. The cover body 20 is secured to the main body portion 10. Under the action of the flange, the sensor assembly 60 is limited within the housing. The sensor assembly 60 is secured relative to the housing. The flange is provided to avoid direct contact between the sensor assembly 60 and the wall surface of the housing, and can play a certain buffering role to protect the sensor assembly 60 when the sensor is impacted.

In some embodiments, the support 610 is fixedly connected to the housing. In an exemplary embodiment, the support 610 is fixedly connected to the cover body 20. Since the support 610 and the housing are fixedly connected, for example, the support 610 and the cover body 20 are fixedly connected, the sensor assembly 60 may be secured relative to the housing.

In some embodiments, the support 610 is provided with sensor fixing positions 640 for disposing the transmitting sensor 620 and the receiving sensor 630 respectively. By disposing the sensor fixing positions 640 on the support 610, the transmitting sensor 620 and the receiving sensor 630 may be quickly mounted on the support 610. Therefore, the mounting is accelerated, and accurate positioning and high mounting precision are guaranteed.

The specific form of the sensor fixing position 640 is not limited. For example, the sensor fixing positions 640 may be mounting cavities of specific shapes on the support 610 for mounting the receiving sensor 630 and the transmitting sensor 620.

In some embodiments, the sensor fixing position 640 includes an accommodating groove 6410, which is configured to accommodate the transmitting sensor 620 or the receiving sensor 630. By mounting the transmitting sensor 620 or the receiving sensor 630 in the accommodating groove 6410, the transmitting sensor 620 or the receiving sensor 630 may be quickly mounted at a specific position of the support 610. The outline of a positioning groove 6420 matches the shape of the transmitting sensor 620 or the shape of the receiving sensor 630, such that the transmitting sensor 620 or the receiving sensor 630 may be secured relative to the support 610.

In some embodiments, the sensor fixing position 640 further includes the positioning groove 6420 communicated with the accommodating groove 6410 and configured to accommodate a radial projection on the transmitting sensor 620 or the receiving sensor 630. The transmitting sensor 620 or the receiving sensor 630 has a columnar body on which the radial projection is provided. For example, the tail end of an infrared LED is provided with a radial projection that is circumferentially annular. The accommodating groove 6410 is configured to accommodate the columnar body, and the positioning groove 6420 is configured to accommodate the radial projection, such that the transmitting sensor 620 or the receiving sensor 630 is secured relative to the support 610.

In some embodiments, a lens 50 and the housing are integrally injection-molded. In an exemplary embodiment, the lens 50 and the housing are integrally two-color injection molded.

Owing to the integrated injection molding of the lens 50 and the housing, the sealing performance of the housing can be improved.

In some embodiments, the lens 50 is disposed on the main body portion 10. The lens 50 and the main body portion 10 are integrally injection-molded. The lens 50 is disposed at the other end of the main body portion 10 opposite to the end having the opening, and the end where the lens 50 is provided is configured to transmit and receive signals, such that when the sensor is mounted on an electronic device, this end is exposed outside the electronic device and is more easily exposed to a humid environment. The main body portion 10 is of an integrated structure, and thus is high in sealing performance. The cover body 20 end is further from the humid environment, further reducing the risk of water vapor entering the housing.

In some embodiments, the other end of the main body portion 10 is provided with a partition portion 110 that divides the lens 50 into a first lens 510 and a second lens 520. The partition portion 110 is disposed at the end of the main body portion 50 where the lens 50 is disposed to divide the lens 50 into the first lens 510 and the second lens 520. The first lens 510 and the second lens 520 may correspond to the transmitting sensor 620 and the receiving sensor 630 respectively.

In some embodiments, a side wall of the main body portion 10 is provided with at least two fixing bulges 120, and the fixing bulge 120 is provided with a threaded hole. The cover body 20 is provided with a through hole 220 opposite to the threaded hole. A threaded part 40 passes through the through hole 220 to be in thread fit with the threaded hole so as to secure the cover body 20 to the main body portion 10. A certain thickness is required for forming the threaded hole, and by disposing the fixing bulge 120 on the side wall of the main body portion 10 and forming the threaded hole in the fixing bulge 120, the wall thickness of the main body portion 10 can be controlled and thus materials can be saved.

In some embodiments, the threaded hole is a blind hole. The threaded hole in the fixing bulge 120 may be either the through hole 220 or the blind hole. In the case that the threaded hole in the fixing bulge 120 is the blind hole, the threaded part 40, such as a screw or a bolt, may be covered to prevent it from being damaged due to exposure to the humid environment.

In some embodiments, the fixing bulge 120 is disposed on the outer wall surface of the side wall of the main body portion 10, such that the space in the main body portion 10 can be effectively utilized. The cover body 20 is provided with a lug 210 corresponding to the fixing bulge 120, and the through hole 220 is provided in the lug 210. Since the lug 210 corresponding to the fixing bulge 120 is disposed on the cover body 20, the material of the cover body 20 can be saved.

In some embodiments, the end having the opening of the main body portion 10 is provided with a sealing groove surrounding the opening, or the cover body 20 is provided with a sealing groove, and the sealing part 30 is embedded into the sealing groove. The sealing part 30 is embedded into the sealing groove, so that the following situation can be avoided: the sealing performance is adversely affected as the sealing part 30 is deformed or displaced by a force.

In some embodiments, the surface of the sealing part 30 may be provided with a continuous projection, and the continuous projection can improve the sealing performance.

In some embodiments, the cover body 20 is provided with a wire hole 230 that allows a wire 70 connected to the sensor assembly 60 to pass through. The cover body 20 is provided with a sealing block 70 for sealing between the wire 70 and the cover body 20. The sealing block 70 is provided with a hole that allows the wire 70 to pass through. The sealing block 70 may be disposed between the hole wall of the wire hole 230 and the wire 70 and may also be disposed at one end of the wire hole 230. In an exemplary embodiment, the cover body 20 is provided with a mounting groove 240 in which the sealing block 70 is disposed. By means of interference fit, the sealing block 70 and the cover body 20 are hermetically connected. By disposing the sealing block 70 between the wire 70 and the hole wall of the wire hole 230, the sealing between the wire 70 and the cover body 20 can be achieved to improve the overall sealing performance of the housing. The sealing block 70 is connected with the cover body 20 in a clamping manner.

In an embodiment of the present application, the sensor may be an infrared sensor. The transmitting sensor 620 and the receiving sensor 630 are an infrared transmitter and an infrared receiver respectively. The sensor may also be a laser sensor. The specific type of the sensor is not repeated herein.

An embodiment of the present application provides a cleaning device. The cleaning device includes the sensor as described in any one of the above embodiments.

In an embodiment of the present application, the sensor is disposed on the cleaning device and may be used as a cliff sensor. The transmitting sensor 620 transmits a signal (for example, an infrared sensor emits infrared light) that is transmitted to the ground by the lens 50 on the main body portion 10, then the ground reflects a light beam into the main body portion 10 through the lens 50, and the light beam is received by the receiving sensor 630. If there is a cliff, the height of the ground may change and the signal received by the receiving sensor 630 may change abruptly or disappear, determining that there is a cliff. At this time, the cleaning device changes the direction or slows down to avoid dropping.

In an embodiment of the present application, the cleaning device includes a sweeping robot, a mopping robot, a mopping-sweeping robot, a disinfecting robot and the like.

The above description is intended to be illustrative rather than restrictive. For example, the above examples (or one or more solutions thereof) can be used in combination with each other, and it is contemplated that these embodiments can be combined with each other in various combinations or permutations. The scope of the present application should be determined with reference to the appended claims and the full scope of equivalents to which these claims are entitled.

What is claimed is:

1. A housing of a cleaning device, comprising a mounting hole for mounting a sensor, wherein a hole wall of the mounting hole is inclined, such that a cross-sectional area of the mounting hole gradually increases from inside to outside; the hole wall is provided with a reflective structure; and the reflective structure divides the hole wall into a plurality of reflecting surfaces, wherein the hole wall is provided with a plurality of steps, and the plurality of steps form the reflective structure.

2. The housing of the cleaning device according to claim 1, wherein the step comprises a step surface and a side surface, and the step surface is parallel to a cross section of the mounting hole.

3. The housing of the cleaning device according to claim 2, wherein the step surface is a matte surface.

4. The housing of the cleaning device according to claim 2, wherein the side surface is perpendicular to the cross section of the mounting hole.

5. The housing of the cleaning device according to claim 1, wherein each of the steps continuously extends along the hole wall.

6. The housing of the cleaning device according to claim 1, wherein a wall surface of the mounting hole is a frustum-shaped surface.

7. The housing of the cleaning device according to claim 1, wherein the mounting hole is provided at a bottom of the housing, and the sensor is oriented to transmit or receive a signal vertically downwards in a case that the cleaning device is in operation, wherein the mounting hole is disposed close to an edge of the housing, and the hole wall close to a side of the edge has a notch.

8. The housing of the cleaning device according to claim 1, wherein a surface of the reflective structure is formed as a matte film.

9. The housing of the cleaning device according to claim 1, wherein the sensor comprises a cliff sensor.

10. A cleaning device, comprising at least one of:

a housing of a cleaning device, comprising a mounting hole for mounting a sensor, wherein a hole wall of the mounting hole is inclined, such that a cross-sectional area of the mounting hole gradually increases from inside to outside; the hole wall is provided with a reflective structure; and the reflective structure divides the hole wall into a plurality of reflecting surfaces; and a sensor, comprising a housing and a sensor assembly disposed in the housing, wherein the housing is provided with a lens and comprises: a main body portion having an opening at one end; a cover body, configured to close the opening of the main body portion and connected to the main body portion through a threaded part; and a sealing part, disposed between the cover body and the main body portion, such that the main body portion and the cover body are hermetically connected.

* * * * *